US005372477A

United States Patent [19]

Cole

[11] Patent Number: 5,372,477

[45] Date of Patent: Dec. 13, 1994

[54] GASEOUS FLUID ASPIRATOR OR PUMP ESPECIALLY FOR SMOKE DETECTION SYSTEMS

[76] Inventor: Martin T. Cole, 7 Loxwood Avenue, Keysborough, Victoria 3173, Australia

[21] Appl. No.: 952,536

[22] PCT Filed: Jun. 19, 1991

[86] PCT No.: PCT/AU91/00261

§ 371 Date: Dec. 9, 1992

§ 102(e) Date: Dec. 9, 1992

[87] PCT Pub. No.: WO91/19906

PCT Pub. Date: Dec. 26, 1991

[30] Foreign Application Priority Data

Jun. 19, 1990 [AU] Australia ..... PK0709

[51] Int. Cl.[5] ..... F04D 29/28

[52] U.S. Cl. ..... 415/218.1; 415/206; 416/188; 416/223 B

[58] Field of Search ..... 416/186 R, 188, 223 B; 415/206, 208.1, 218.1

[56] References Cited

U.S. PATENT DOCUMENTS

| | | | |
|---|---|---|---|
| 2,165,808 | 7/1939 | Murphy | 416/186 R |
| 2,796,836 | 6/1957 | Buchi | 416/186 R |
| 2,827,261 | 3/1958 | Parker et al. | 415/77 |
| 2,874,922 | 2/1959 | Whitcomb | 244/130 |
| 3,181,471 | 5/1965 | Poole | 415/218.1 X |
| 3,260,443 | 7/1966 | Garnett et al. | 416/186 R |
| 3,788,765 | 1/1974 | Rusak | 415/227 |
| 3,806,067 | 4/1974 | Kutney | 415/79 |
| 3,964,841 | 6/1976 | Strycek | 416/186 R X |
| 4,171,183 | 10/1979 | Cornell et al. | 416/94 |
| 4,677,828 | 7/1987 | Matthews et al. | 415/914 |

FOREIGN PATENT DOCUMENTS

| | | |
|---|---|---|
| 1043168 | 9/1966 | United Kingdom . |
| 382849 | 9/1973 | U.S.S.R. . |

*Primary Examiner*—Edward K. Look
*Assistant Examiner*—Michael S. Lee
*Attorney, Agent, or Firm*—Learman & McCulloch

[57] ABSTRACT

A gaseous fluid aspirator/pump apparatus including a rotary impeller (10) with radially extending blades, the impeller being mounted in a housing having a gaseous fluid inlet and outlet wherein gaseous fluid moving from the inlet (15) to the outlet (14) is turned from axial flow into the impeller to radial flow from the impeller, said impeller and an associated portion of the housing (16) being shaped to prevent flow separation and turbulence in the gaseous fluid stream while under the influence of the impeller. The impeller inlet (15) includes an inlet configuration of curvate conical from matching the configuration of the housing (16) in the area of the inlet opening. This configuration acting to prevent flow separation while turning the fluid flow through a large angle of approximately 90° and acceleration and deceleration of the fluid flow is substantially prevented.

4 Claims, 8 Drawing Sheets

Measured performance curve

Response time vs pipe length

GASEOUS FLUID ASPIRATOR OR PUMP ESPECIALLY FOR SMOKE DETECTION SYSTEMS

The present invention relates to improvements relating to a gaseous fluid aspirator or pump particularly but not exclusively to an aspirator for an optical air pollution apparatus particularly a very early warning smoke detector apparatus adapted to summon human intervention before smoke levels become dangerous to life or delicate equipment. It can cause early or orderly shut down of power supplies and it can operate automatic fire suppression systems.

The present invention will be described with reference to an aspirator for use with very early warning smoke detection apparatus. Smoke detection apparatus of the type described in applicants U.S. Pat. No. 4,608,556 directed to a heat-sensitive/gas-sampling device in a smoke detector system including sampling pipes and an apertured housing in association with a smoke detection device of the type described in U.S. Pat. No. 4,665,311 which has a sampling chamber as illustrated in FIG. 1 of the drawings therein. With reference to FIG. 7 of the U.S. Pat. No. 4,608,556 there is shown schematically a reticulation fluid/smoke mixture transport system of sampling pipes leading to various sampling areas to continuously sample air from those various areas. The transport system leads back to a sampling chamber of the type for example that is described in U.S. Pat. No. 4,665,311. However, it will be equally applicable to other apparatus requiring efficient long-lived operation of an aspirator at low power consumptions.

The smoke detector utilizes an airtight chamber through which a representative sample of air within the zone to be monitored, is drawn continuously by an aspirator. The air sample is stimulated by an intense, wide band light pulse. A minuscule proportion of the incident light is scattered off airborne particles towards a very sensitive receiver, producing a signal which is processed to represent the level of pollution in this instance of smoke. The instrument is extremely sensitive, so much so that light scattered off air molecules alone may be detected. Therefore, minor pollution is readily detectable as an increased signal. Therefore, the detector which is utilizable in commercial situations, is extremely sensitive and yet has a low incidence of false alarms.

It is extremely important that the means for obtaining a continuous sample of the air to be monitored is reliable, efficient, consumes only a small amount of power and has a long life. It is also important that the aspirator develops a relatively high pressure and pressure and draws a relatively large volume of air given its low power rating in order that there is little or no delay in the detection of smoke or like pollution in a dangerous situation.

Existing aspirator systems as currently used, utilize an axial flow fan providing relatively low cost and long life coupled with ready availability. However, known equipment has a very low efficiency of less than 2% at flow rates of 40 liters per minute. Such low efficiency is considered unsatisfactory particularly if increased flow rates with reduced power input is to be attainable.

Thus it is an objective of the present invention to provide a gaseous fluid aspirator/pump having relatively high pressure output with increased efficiency and decreased power requirements.

A more specific objective is to provide an efficient aspirator of the order of 20% efficiency, having a capacity of the order of 60 liters per minute at a pressure of the order of 300 Pascals with an input of about 2 watts and having a long reliable life.

There is provided according to the present invention a gaseous fluid aspirator/pump apparatus including an impeller with a plurality of blades, the impeller comprising a pair of shrouds being mounted in a housing having a gaseous fluid inlet and outlet said pair of shrouds providing an inlet throat, said inlet throat having an inlet and an outlet in which gaseous fluid moving from the throat inlet to the throat outlet is turned from axial flow to radial flow into the impeller blades, said impeller being configured in matching curvate conical form in the area of the inlet throat wherein the inlet throat is shaped to maintain a substantially constant cross-sectional flow area throughout the curved volume of the inlet throat until the blade passage is reached.

Specifically the impeller inlet includes an inlet configuration of curvate form in which the cross-sectional flow area is maintained constant by projecting a truncated conical section around the inlet throat until the blade passage is reached.

Thus flow separation is prevented while turning the fluid flow through 90° and acceleration and deceleration of the fluid flow is substantially prevented, minimizing losses.

Turbulent eddies are minimized and uniform velocity distribution is achieved. The impeller blade inlet angle can be set by conventional velocity-triangle means and the number of blades is optionally set at 12.

The invention will be described in greater detail having reference to the accompanying drawings in which FIG. 1 is a cross-sectional view of the aspirator showing the configuration of the impeller and housing inlet. FIG. 2 is a frontal view of the impeller blades.

Figure 1:
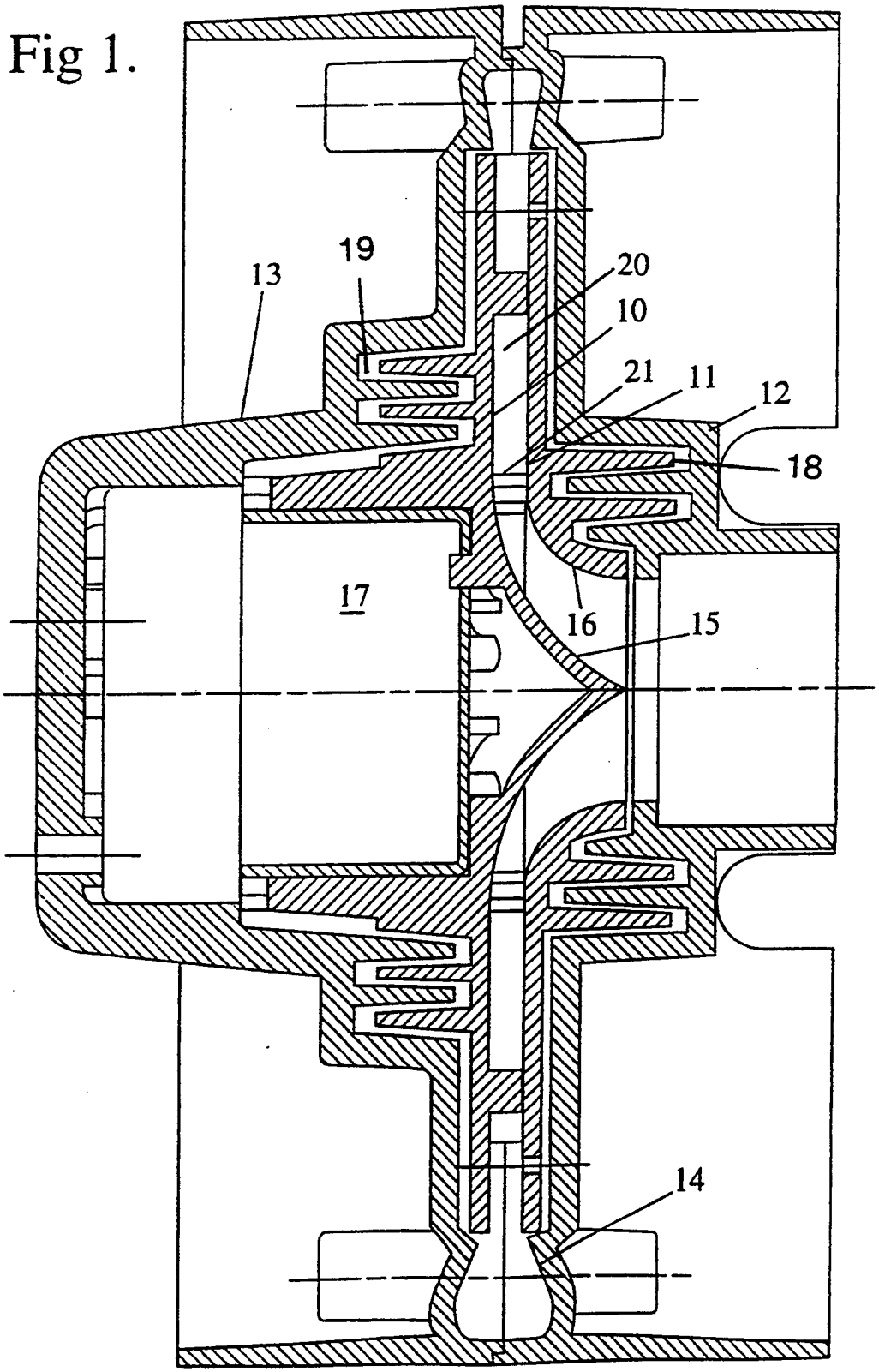

The aspirator shown in FIG. 1 includes an impeller 10 and inlets throughout 11 forming a curvate inlet cavity with surfaces 15, 16 presenting a constant cross-sectioned area to the fluid stream for receiving incoming air and turning it through 90° into impeller blades to travel to the peripheral chamber 14, forming a rounded trapezoidal volute.

The impeller includes a cavity 17 for housing a small DC brushless motor (not shown). To minimize temperature rise, and therefore improve bearing life, a cooling fan is preferably incorporated for the motor. To minimize friction losses labyrinth seals 18, 19 are provided.

Figure 2:
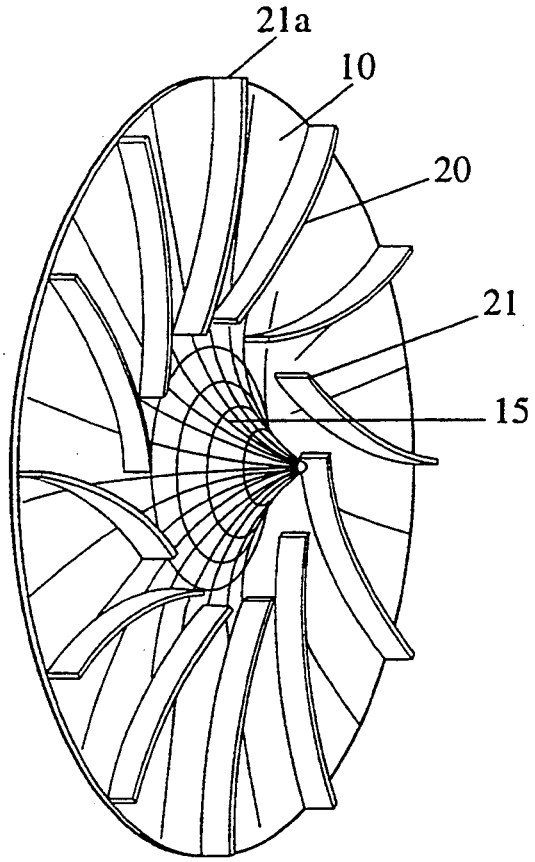

With reference to FIG. 2 of the drawings the blades 20 of the impeller are of minimum thickness (1 mm) to reduce energy losses. The leading edges 21 of the blades are rounded parabolically to avoid a narrowing of the channel width to minimize acceleration of the air stream.

No detailed information can be found regarding the design of the impeller inlet throat geometry (including the boss profile), its importance being all-too-readily dismissed by others. However, this can hold the key to high efficiency so a method was derived from first principles, to minimize energy loss by:

* preventing flow separation while turning the airflow through 90°,
* preventing acceleration or deceleration of the airflow, and by preparing the airstream for presentation to the blade channel entrance in such a manner that, within the blade channels:
* flow separation and eddies would be minimized, and
* a uniform velocity distribution would be achieved.

This method resulted in a parabolic boss profile in which it was possible to emulate this shape to a high accuracy by specifying a short circular arc.

The blade inlet angle was set by conventional velocity-triangle means, and the number of blades was set at 12.

To minimize energy loss caused by the blade leading-edges, the blades are designed with minimum thickness (1 mm). However, when set at the required angle, their effective thickness is 2.7 mm. With 12 blades their combined thickness would constitute a significant reduction in the inlet cross-sectional area, so the channel depth is increased (with a smooth transition) at the leading-edge to maintain a constant mean air velocity. Moreover, the blade leading-edges are rounded parabolically (see FIG. 10) (rather than a conventional wedge-shape) to remove a narrowing of the channel width which would also accelerate the airstream, thus incurring loss.

The blade channel is preferably maintained at a constant depth of 3.3 mm by parallel shrouds. The blades are preferably curved to achieve radially extending tips thereby producing a maximum static head matched by a dynamic head component that must be converted to static head in the outlet diffuser attached to the spiral volute. The spiral volute geometry has an expanding rounded-trapezoidal design modified to fit within the available space, complete with an 8° diffuser nozzle for which a trapezoidal to circular transition was required. It is possible to match the inlet and outlet couplings exactly to mate with the standard 25 mm pipe work carrying the gaseous fluid for sampling. This enables the staging of multiple aspirators where higher pressures may be needed and facilitates the attachment of an exhaust pipe to overcome room pressure differentials that sometimes occur, for example in computer rooms.

Figure 5:
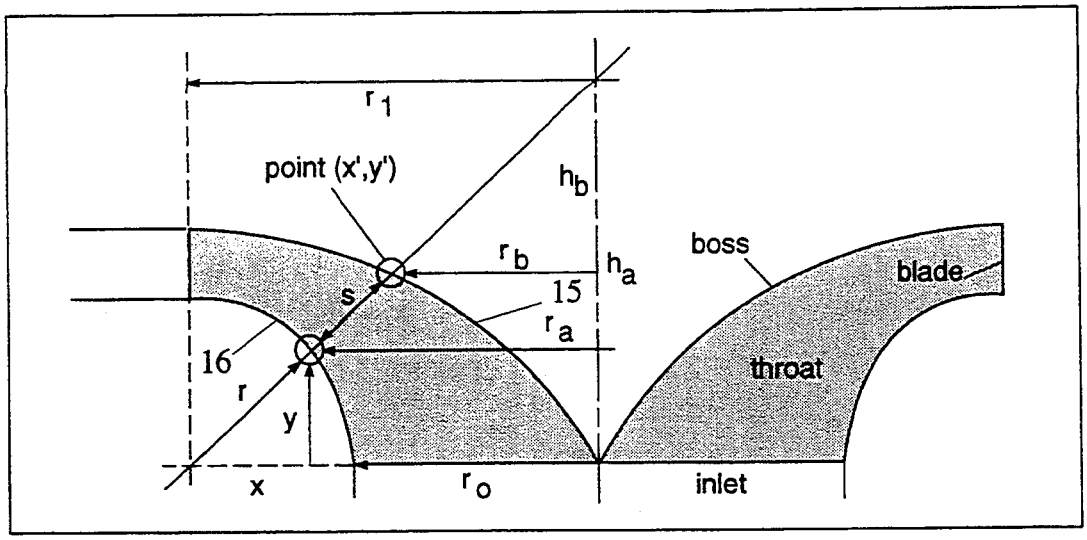
FIGS. 5 and 6 show schematically the derivation of impeller throat dimensions and composition of inlet boss profile.
Figure 6:
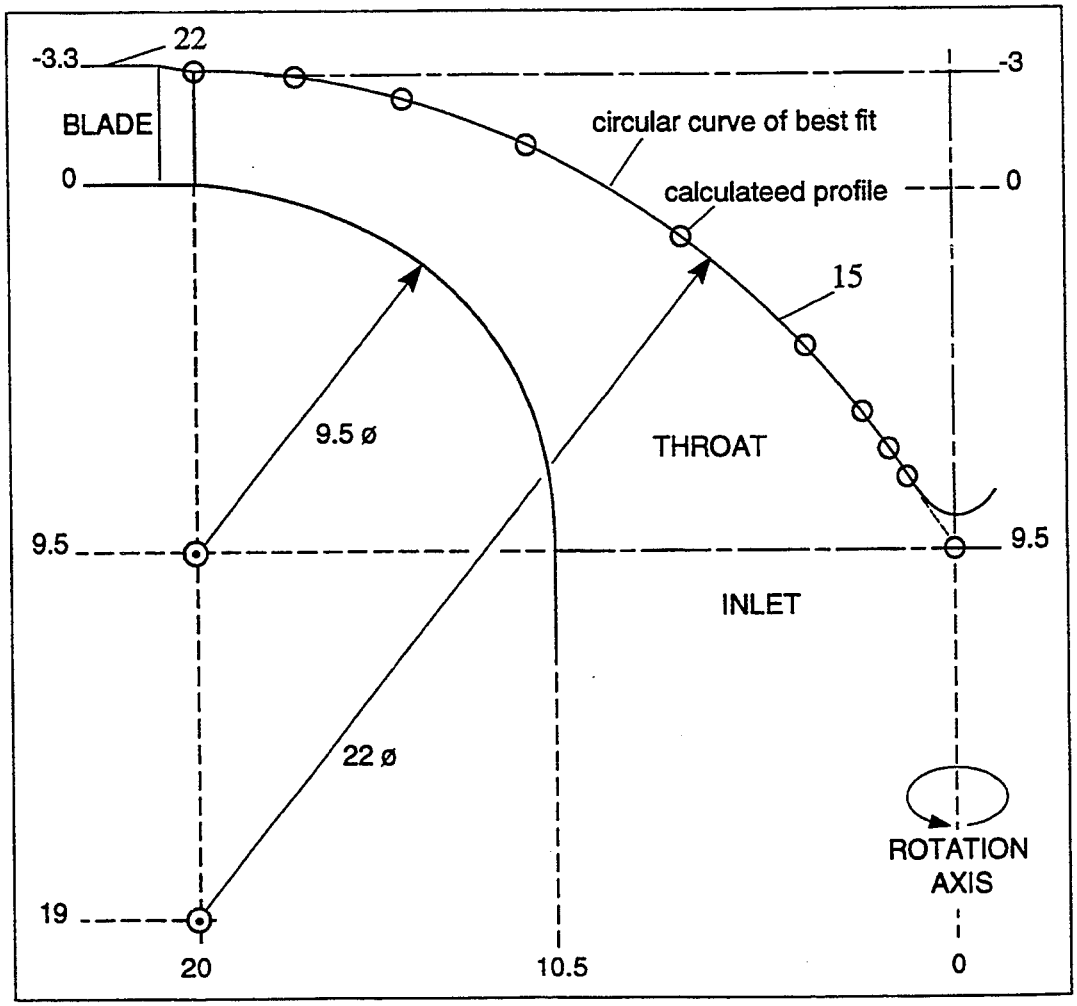

With reference to FIGS. 1, 5 and 6, details of the formation of the inlet throat 15,16 will be described.

For minimum loss the airstream should be directed to flow parallel to the walls of the throat. Accordingly, the cross-sectional area should be measured perpendicular to that flow, i.e. perpendicular to the throat walls. In practice however, the throat walls themselves (turning through 90°) cannot be parallel if a uniform cross-sectional area is to be achieved. Moreover, in computing the throat area, only one wall shape was defined in the first instance, so the extent to which the second (boss) wall might not be parallel, was not yet known. To obtain a cross-sectional area measured at an angle which averaged perpendicularity to both walls (i.e. perpendicular to a centreline), would require an iterative process.

However, this extra effort could be counter-productive because it is possible that the airstream would flow partially in shear, due to incomplete turning. Moreover, at the pipe-throat interface, the bulk of the mass flow is biased towards the first wall (simply because the cross-sectional area of any annular ring of given width is proportional to the annular radius squared). Therefore it would seem most appropriate to calculate the cross-sectional area perpendicular to this first wall.

In visualising this area three-dimensionally, it was discovered that the cross-section at any point along the throat is described by the surface of a truncated cone (see FIG. 5).

Available literature provided differing formulae for the sloping-surface area (excluding the base) of a regular cone, e.g.: $S = pi\ r\ (r+h)$. However, this formula was found incorrect, failing the simple test of mathematically comparing (say) the area of a known semicircle, pulled into the shape of a cone or "Indian teepee".

An alternative formula was derived from first principles and was subjected to rigorous testing. Accordingly, the surface area $A_s$ of a cone of base radius r and height h is given by:

$$A_s = pi\ r\ h\ (1+(r/h)^2)^{.5}$$

And for a truncated cone the surface area becomes:

$$A_s = pi\ (r_2\ h_2 - r_1\ h_1)\ (1+(r_2/h_2)^2)^{.5}$$

By application of this formula to the impeller configuration as illustrated in FIG. 5, it has been possible to derive the following equation which has also been rigorously tested by "longhand" calculations:

$$r_b = ((r_1-x)^2 - r_0^2 x/(r_1-r_0))^{.5}$$

This general solution may be simplified by substitution of $r_0 = 10.5$ and $r_1 = 20$ which have been determined for this particular impeller design:

$$r_b = ((20-x)^2 - 11.6\ x)^{.5}$$

which may be solved for various values of x. However, the resulting values for $r_b$ may be more easily handled by convening to x', where:

$$x' = r_1 - r_b = 20 - r_b = 20 - ((20-x)^2 - 11.6\ x)^{.5}$$

The vertical coordinates, y and y' are determined by the value of x, because of the circular curvature of the first throat wall and congruency of the triangles:

$$y = (r^2 - x^2)^{.5} = (90 - x^2)^{.5}$$

$$y' = y\ x'/x$$

By plotting the coordinates (x',y') obtained for several values of x, it is possible to determine the curve of best fit, as illustrated in FIG. 6.

Fortunately, a satisfactory fit to this parabola was achieved using a circular curve. In the case of this impeller, the best-fit radius of curvature was found to be 22 mm, drawn tangentially to the blade channel. Conveniently this approach requires that the part-circle is constructed with its centre at the set distance $r_1 = 20$ mm from the impeller centerline.

Whereas the curve of best fit requires a very sharp central tip for the boss, to assist with die fabrication and to allow the extraction of each molded part without breakage, and to provide a more-conventionally aerodynamic leading edge, it is proposed that the central point should be rounded 24 as indicated in FIG. 6. It is expected that in practice, this minor rounding would have a negligible effect upon any aspect of the impeller performance. Indeed, this type of rounding (though with a much greater radius) is reminiscent of the round-headed impeller-retaining nuts commonly used in larger cast metal centrifugal pumps.

BLADE PASSAGE ENTRY

Now, at the leading edge of the blades there exists the potential for a sudden change in area which would introduce losses. This change in area arises from the thickness of the blades. If the throat width immediately ahead of the blades was made equal to the blade width, there would be a reduction in area upon entering the blade passage. Alternatively, if the throat width were reduced so that the throat area equalled the blade passage area, there could be an equally lossy discontinuity because of the necessary difference in widths.

The solution lies with shaping the blade passage entry according to the shape of the leading-edge of the blades. As the airflow encounters the blade leading-edge, the passage width should expand smoothly from the required throat width to the required blade width, maintaining a uniform cross-sectional area. This expansion taper should be completed within the length of the blade shaping.

It would seem ideal to ensure that the shaping and the taper were made complementary throughout the transition, but this would suggest wedge shapes and in practice it is expected that the simple provision of smooth curves in both dimensions would minimize loss.

As illustrated in FIG. 6, it is desirable to provide the expansion taper 22 on one shroud only, i.e. the motor side. This simplifies the design, by leaving the inlet-side shroud unaltered. More importantly, a tapered expansion of the inlet shroud would tend to promote flow separation within the blade passage.

With reference to FIGS. 7 to 10 detailed description of the blade entry design will be made.

Figure 7:
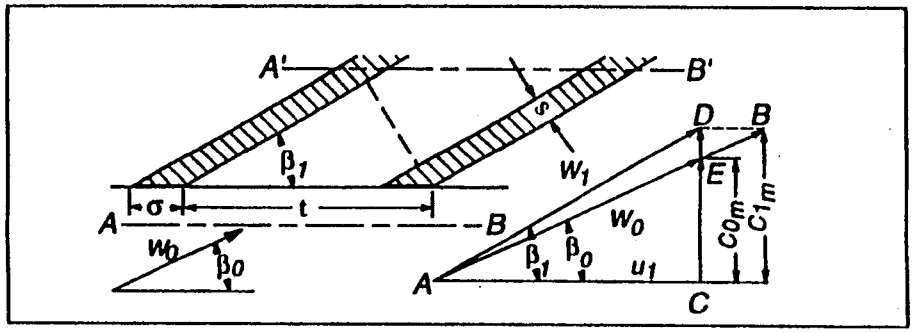
FIG. 7 shows impeller inlet area calculation according to Eck.

According to Eck the effective thickness (t') of each blade is larger than the actual thickness (t), depending upon the acuteness of the inlet angle ($B_1$). This is illustrated in FIG. 7, where for simplicity the inlet circle has been straightened-out (Eck uses different symbols, namely s=t, sigma=t'). The effective thickness is easily obtained by geometry:

$$t'=t/\sin(B_1)=1/\sin(25)=2.4 \text{ mm}$$

Figure 8:
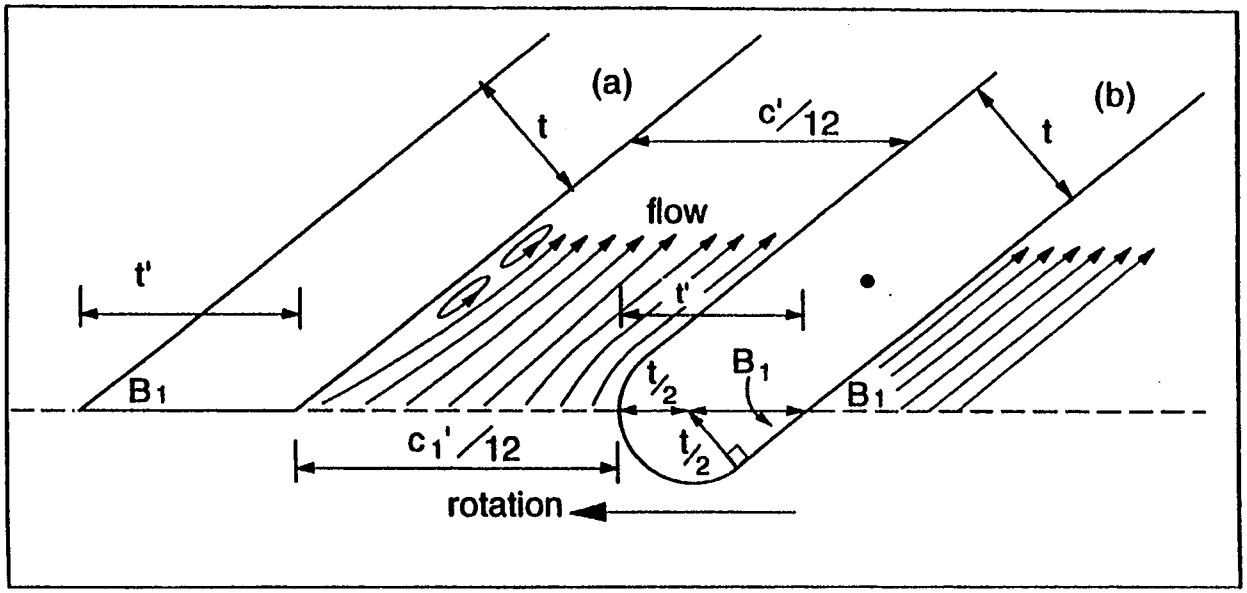
FIG. 8 shows impeller blade leading-edge profiles.

FIG. 8 compares the effects of using the chisel-shaped leading-edge of Eck, with a rounded shape which is preferred. This rounded shape is more practicable to mold and should reduce the entry shock losses including flow separation behind the blade, particularly at flow rates significantly below the rated capacity of the impeller (where a rounded shape would adapt more readily to differing velocity angles).

It can be shown (with reference to FIG. 8) that in the case of a rounded shape, the effective thickness is obtained by a modified equation:

$$t'=t\,(1+1/\sin(B_1))/2=1*(1+1/\sin(25))/2\ =1.7 \text{ mm}$$

Figure 9:
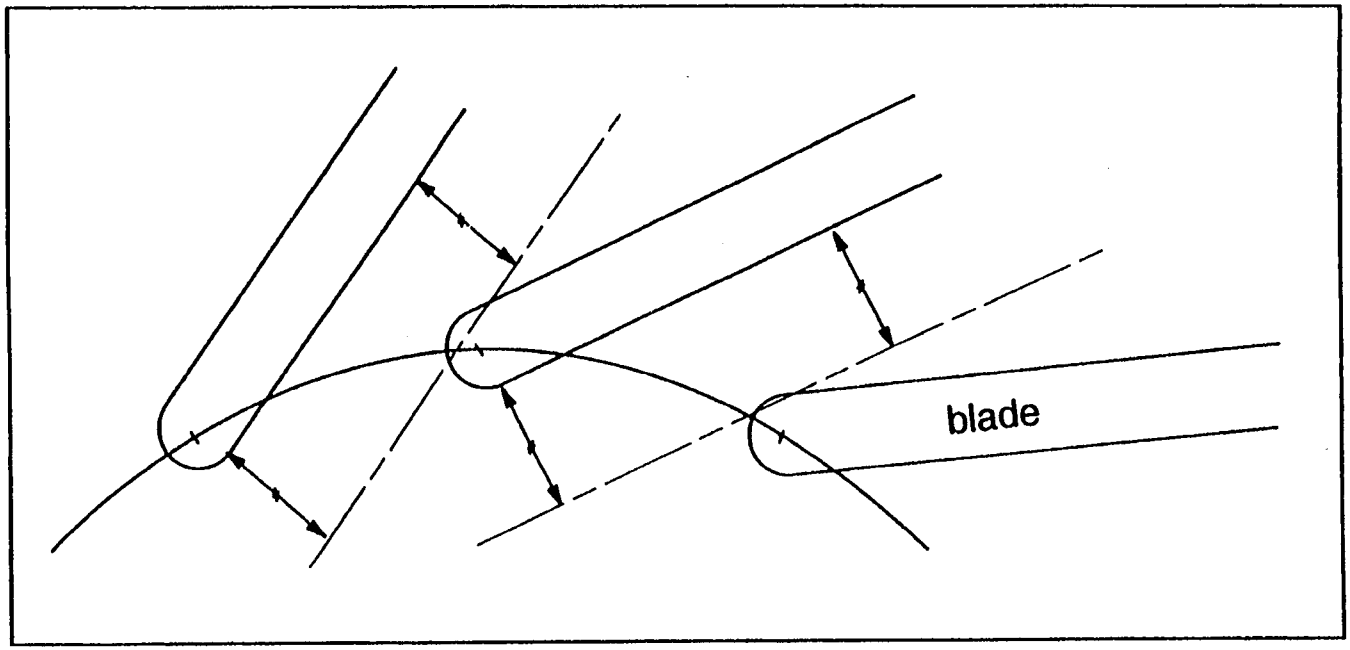
FIG. 9 shows inlet area reduction caused by rounded leading-edge.

Unfortunately, it can be seen from FIG. 9 that Eck's concept of straightening-out the inlet circle disguises another effect. In practice the blades cannot be regarded as parallel and there is a degree of narrowing of the blade passage as the airstream passes the rounded leading-edge. Any such narrowing would cause a momentary increase in air velocity (acceleration), resulting in loss. This narrowing is caused by the acute angle of the back of the next blade. In the case of a 12-blade impeller, the next blade is advanced by 360/12=30°.

Figure 10:
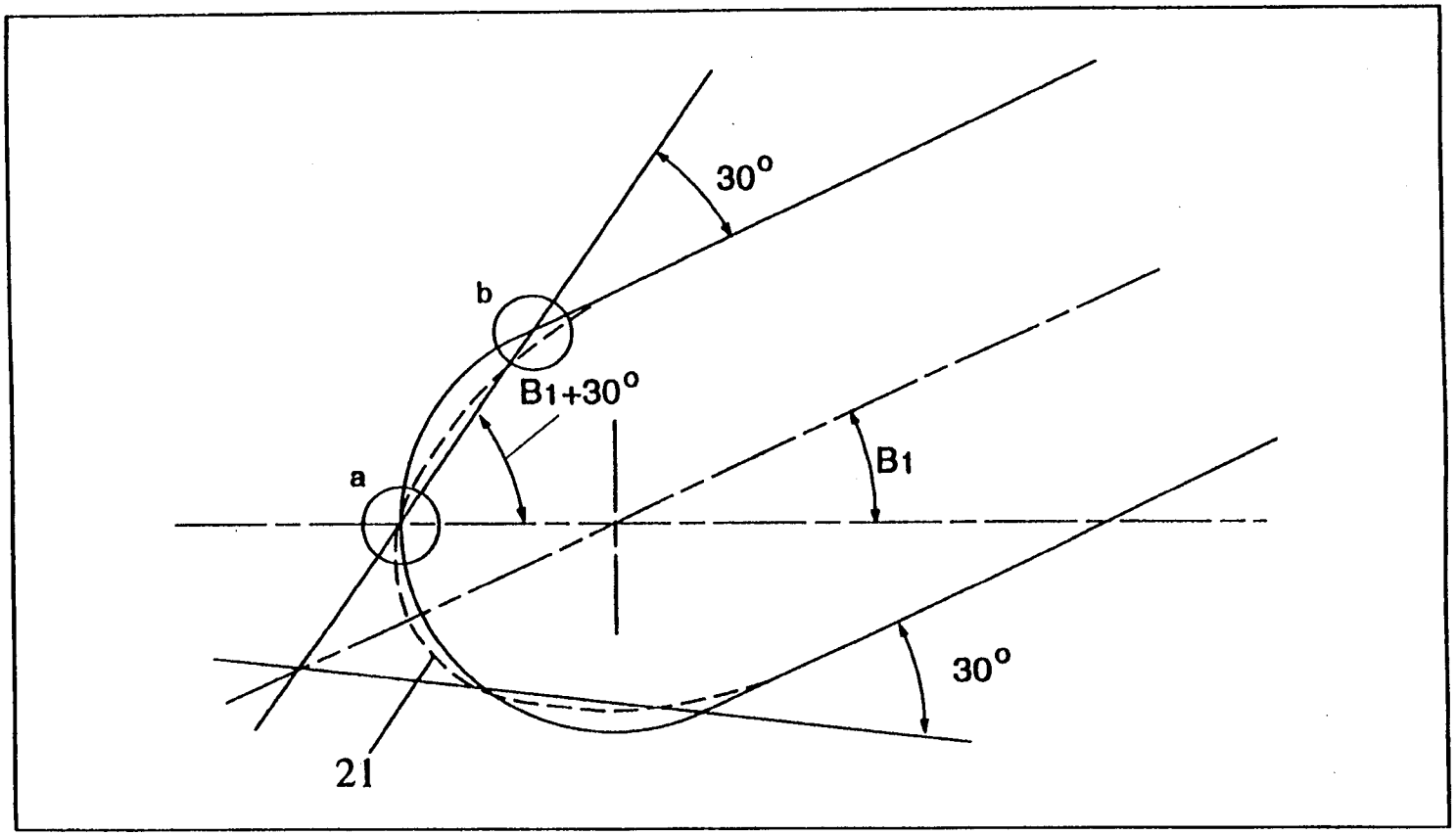
FIG. 10 shows modification of blade leading-edge.

Therefore the leading-edge should be "sharpened" as indicated in FIG. 10, to avoid the momentary narrowing of the blade passage area. This is achieved by constructing a line parallel to the next blade (30° advanced), intersecting with the inlet tangent (at 20 mm radius), as shown at point "a". This line is inclined to the inlet tangent at the required rake angle of ($B_1$+360/z)=55°, intersecting with the edge of the blade at point "b". The other side of the blade is similarly treated to achieve symmetry.

Ideally the sudden transitions (sharp edges) produced by this sharpening should be smoothed by using appropriate curves as shown (dashed). The resulting shape more closely resembles a classical aerodynamic profile.

Although it was initially regarded as important to utilize a semicircular leading-edge for simplicity in mold fabrication, such a narrow (1.0 mm) blade thickness would require spark-erosion milling in any case, so the aerodynamic profile would be only slightly more expensive to mill.

It is interesting to note that for the range of possible values of $B_1$ (0° to 90°), for an impeller with 12 blades there is no sharpening required if $B_1$ exceeds 60°. The maximum sharpening (30° rake) occurs for $B_1$=0.

According to the leading-edge profile of FIG. 10 it is possible to retain the previously-calculated effective blade thickness, namely 1.7 mm. Utilizing this figure, the useable inlet circumference reduces to:

$$C_1'=C_1-z\,t'=126-12*1.7=106 \text{ mm}$$

To produce an inlet area equal to the pipe area, the blade width at the impeller inlet should be:

$$W_1=A_0/C_1'=346/106=3.3 \text{ mm}$$

Additional constructional features provided in the pump housing incorporates isolation of the aspirated air from the ambient air to enable operation in hazardous areas. To achieve this, the motor labyrinth is designed as a flame trap to comply with Australian standards.

Figure 3:
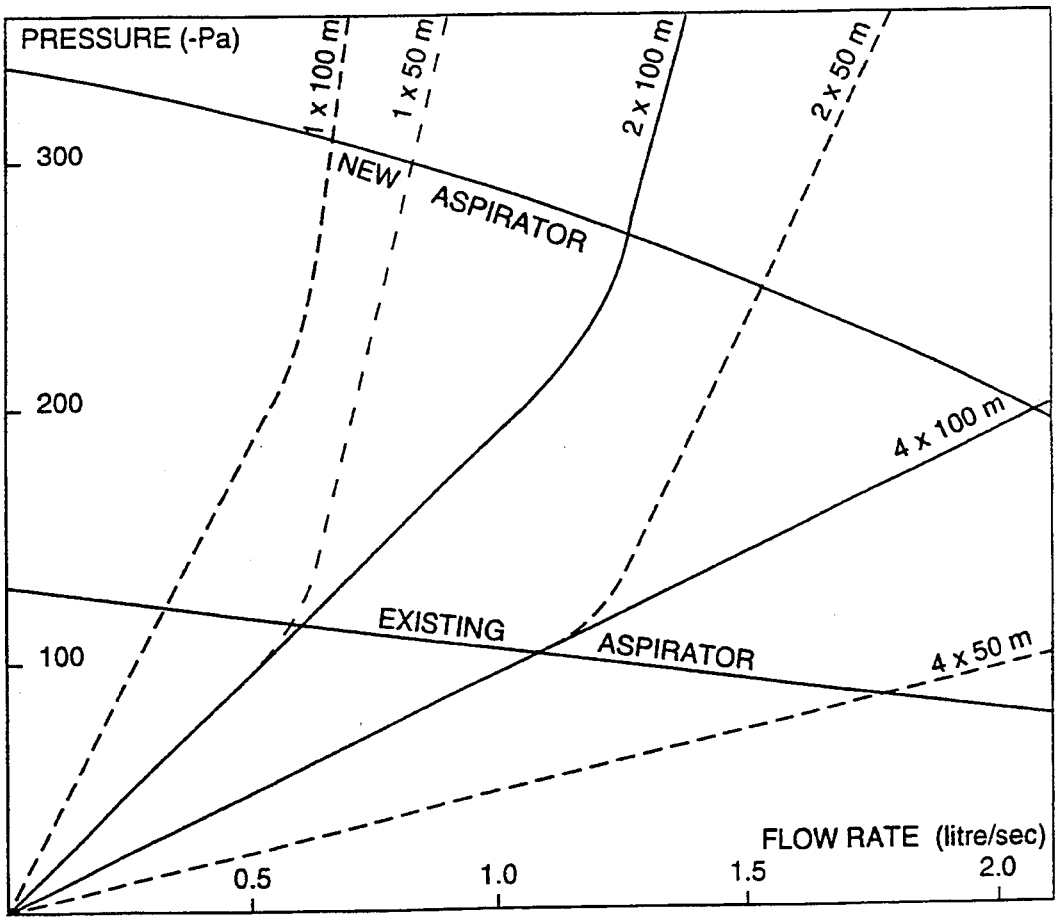
FIG. 3 shows a measured comparison of performance curves between a conventional aspirator and the aspirator of the invention.
Figure 4:
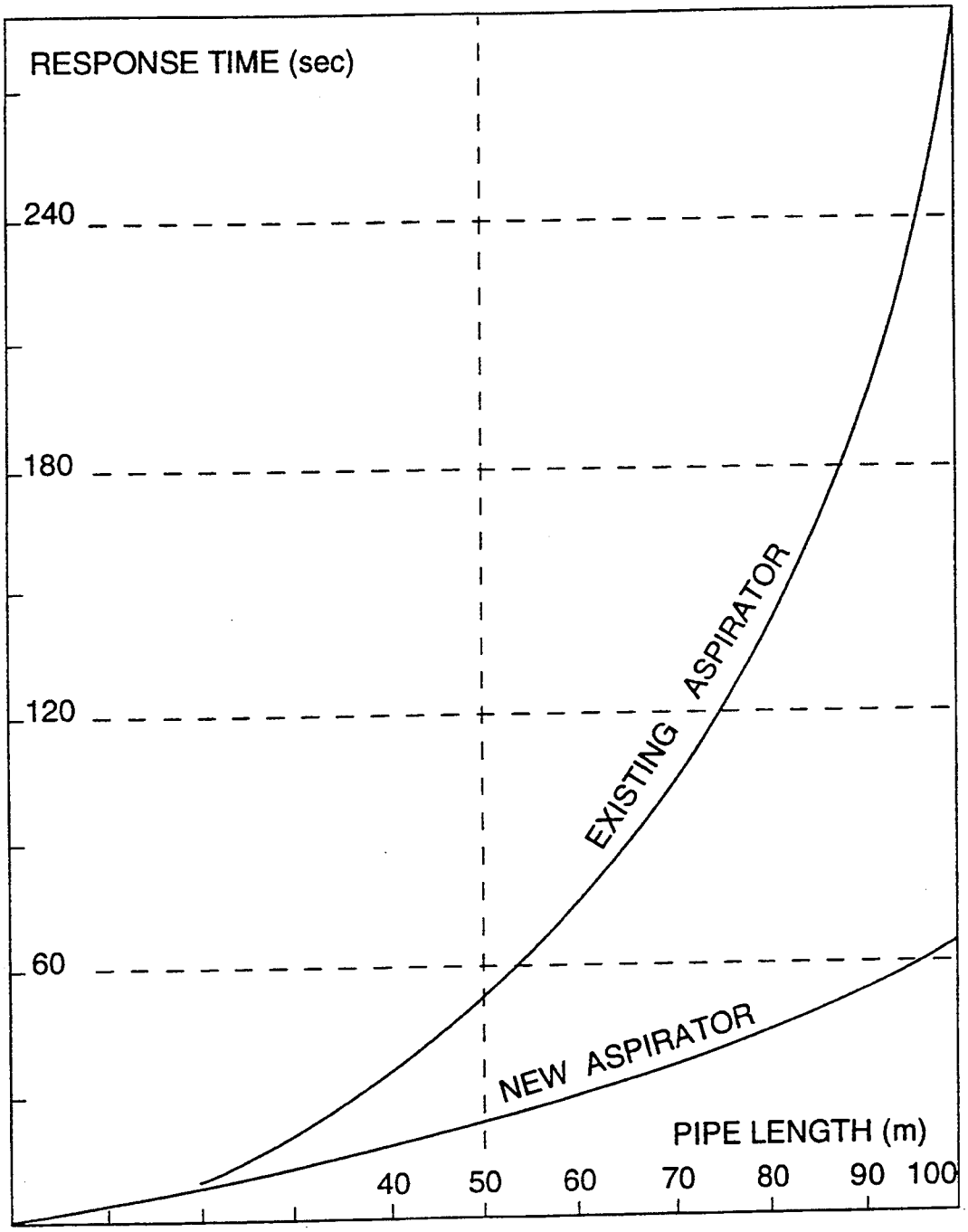
FIG. 4 shows comparative response times for a given length of pipe.

FIGS. 3 and 4 give graphical representations of the performance of the aspirator as described herein as compared with the conventional aspirator currently utilized in the early warning smoke detection apparatus.

With reference to FIG. 3, the increased pressure possible with the new aspirator is shown and in one example with a 100 meter pipe a pressure rise in excess of 300 Pascals at a speed of 3,800 rpm was achieved at a power train of only 2 watts which is less than half that of the original aspirator. The sustained good performance at relatively high flow rates provides a distinct advantage for use with large numbers of pipes and sampling holes without compromising the operation of single pipe systems.

With reference to FIG. 4, this shows the drastically improved response times of the aspirator according to the invention as against the length of pipe whereby in a 100 meter pipe the smoke transport time is reduced by a factor of 4. With shorter less restrictive pipes the improvement is less dramatic but nevertheless the time is halved for a 50 meter pipe.

Calculations have shown that the peak total efficiency of the aspirator was in fact 21%. Therefore, taking into account the known motor efficiency, the peak impeller efficiency proved to be 49% which for an impeller pump of such low specific speed as in the present example, such results are well in advance of normal expectations. Moreover it has been found that the impeller achieves an internal efficiency of 81% given the special attention made to the inlet throat geometry and blade design.

The parts of the aspirator can be injection molded thereby allowing automatic production and assurance of repeatable quality. These factors significantly increase factory capacity committing a rapid response to increasing market demand while assisting to maintain an internationally competitive cost structure. The invention provides an improved system performance for early fire detection, however, the scope of application for the aspirator is considerably widened where low power input and fast response are required such as in battery-powered or solar-powered air pollution monitoring applications.

I claim:

1. A gaseous fluid aspirator/pump apparatus including an impeller having a plurality of blades, said impeller comprising a pair of shrouds mounted in a housing having a gaseous fluid inlet and outlet, said pair of shrouds providing an inlet throat having an inlet and outlet in which gaseous fluid moving from the throat inlet to the throat outlet is turned from axial flow to radial flow into the impeller blades, said impeller being configured in matching curvate conical form in the vicinity of the inlet throat wherein the inlet throat is shaped to maintain a substantially constant cross-sectional flow area throughout the curved volume of the inlet throat until the blade passage is reached, the inlet throat being curved substantially parabolically so that said substantially constant cross-sectional flow area is maintained to minimize acceleration and deceleration of the gaseous stream and restrict flow separation and turbulence in the fluid stream, and said blades having leading edges confronting incoming gaseous fluid from the throat outlet, the leading edges being rounded substantially parabolically to resemble an aerodynamic profile and substantially avoid a narrowing of the blade passage caused by the blade thickness.

2. The apparatus according to claim 1 wherein the blade passage in the shrouds is increased to compensate for area reduction caused by the finite blade thickness thereby to prevent flow separation and maintain a substantially constant mean velocity of the gas stream.

3. A smoke detection system including apparatus according to claim 2.

4. A smoke detection system including apparatus according to claim 1.

* * * * *

UNITED STATES PATENT AND TRADEMARK OFFICE

CERTIFICATE OF CORRECTION

PATENT NO. : 5,372,477
DATED : December 13, 1994
INVENTOR(S) : Martin T. Cole

It is certified that error appears in the above-indentified patent and that said Letters Patent is hereby corrected as shown below:

Column 4, line 46, change "convening" to -- converting --;

Column 6, line 58, change "train" to -- drain --;

Column 8, line 26, change "2" to -- 1 --;

Column 8, line 28, change "1" to -- 2 --.

Signed and Sealed this

Twenty-first Day of March, 1995

*Attest:*

Bruce Lehman

BRUCE LEHMAN

*Attesting Officer*

*Commissioner of Patents and Trademarks*